US010934864B2

(12) United States Patent
Lee

(10) Patent No.: US 10,934,864 B2
(45) Date of Patent: Mar. 2, 2021

(54) APPARATUS FOR AXIAL LOCKING OF BUCKET AND BUCKET ASSEMBLY AND GAS TURBINE HAVING THE SAME

(71) Applicant: DOOSAN HEAVY INDUSTRIES & CONSTRUCTION CO., LTD, Changwon-si (KR)

(72) Inventor: Jong Wook Lee, Changwon-si (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 255 days.

(21) Appl. No.: 15/793,486

(22) Filed: Oct. 25, 2017

(65) Prior Publication Data

US 2018/0266260 A1 Sep. 20, 2018

(30) Foreign Application Priority Data

Mar. 16, 2017 (KR) ..... 10-2017-0033178

(51) Int. Cl.
*F01D 5/32* (2006.01)
*F01D 5/30* (2006.01)
*F01D 11/00* (2006.01)

(52) U.S. Cl.
CPC ..... *F01D 5/323* (2013.01); *F01D 5/3007* (2013.01); *F01D 5/3015* (2013.01); *F01D 5/3053* (2013.01); *F01D 11/006* (2013.01); *F05D 2230/64* (2013.01); *F05D 2260/30* (2013.01)

(58) Field of Classification Search
CPC . F01D 5/32; F01D 5/323; F01D 5/326; F01D 5/3053
See application file for complete search history.

(56) References Cited

U.S. PATENT DOCUMENTS 2,620,539 A 12/1952 Poupitch
2,702,031 A * 2/1955 Wenger ..... A61B 17/7055 606/51
2,801,074 A * 7/1957 Brown ..... F01D 5/323 416/221
3,076,634 A * 2/1963 Boyle ..... F01D 5/323 416/221
4,502,841 A * 3/1985 Kebedjis ..... F01D 5/326 416/220 R
4,505,640 A 3/1985 Hsing et al.
5,984,639 A 11/1999 Gekht et al.
(Continued)

FOREIGN PATENT DOCUMENTS

CN 203335139 U 12/2013
DE 102008002932 A1 1/2009
(Continued)

*Primary Examiner* — Nathaniel E Wiehe
*Assistant Examiner* — Brian O Peters
(74) *Attorney, Agent, or Firm* — INVENSTONE Patent, LLC

(57) ABSTRACT

An apparatus for axial locking of a bucket includes a depressed portion formed on an end portion of a male dovetail extending from a bucket and on an outer side of a seating groove of a female dovetail disposed on an outer circumferential surface of a rotor disk, and a locking member disposed in the depressed portion and configured to contact the male dovetail and the seating groove of the female dovetail to prevent the bucket mounted on the rotor disk from being separated in the axial direction.

19 Claims, 11 Drawing Sheets

(56) References Cited

U.S. PATENT DOCUMENTS

| | | | | |
|---|---|---|---|---|
| 10,563,526 | B2 * | 2/2020 | Kang | F01D 5/32 |
| 2009/0022592 | A1 | 1/2009 | Liotta et al. | |
| 2009/0148298 | A1 | 6/2009 | Strohl et al. | |
| 2012/0177498 | A1 | 7/2012 | Yarava et al. | |

FOREIGN PATENT DOCUMENTS

| | | | |
|---|---|---|---|
| EP | 2532835 | A2 | 12/2012 |
| GB | 793931 | * | 4/1958 |
| JP | 60192201 | U | 12/1985 |
| KR | 20010050226 | A | 6/2001 |

* cited by examiner

APPARATUS FOR AXIAL LOCKING OF BUCKET AND BUCKET ASSEMBLY AND GAS TURBINE HAVING THE SAME

CROSS-REFERENCE TO RELATED APPLICATIONS

This application claims priority to Korean Patent Application No. 10-2017-0033178, filed on Mar. 16, 2017, the disclosure of which is incorporated herein by reference in its entirety.

BACKGROUND

Exemplary embodiments of the present disclosure relate to an apparatus for axial locking of a bucket and a bucket assembly, and a gas turbine having the same. More particularly, the exemplary embodiments are directed to a structure capable of reducing windage loss due to rotation and additionally securing an axial clearance by disposing, in a depressed manner, a locking member for locking a bucket to a rotor to prevent the bucket from being separated in an axial direction during operation.

In general, a turbine is a power generating device converting heat energy of fluids, such as gas and steam, into a rotational force which is mechanical energy. A turbine comprises a rotor that includes a plurality of buckets so as to be axially rotated by the fluids and a casing that is installed to surround a circumference of the rotor and includes a plurality of diaphragms.

A gas turbine is configured to include a compressor section, a combustor, and a turbine section. Outside air is sucked in and compressed by a rotation of the compressor section and then is sent to the combustor. The compressed air and fuel are mixed with each other in the combustor to be combusted. High-temperature and high-pressure gas generated from the combustor rotates the rotor of the turbine while passing through the turbine section to drive a generator.

In the case of a steam turbine, a high-pressure turbine section, an intermediate-pressure turbine section, and a low-pressure turbine section are connected to each other in series or in parallel to rotate the rotor. In the case of the serial structure, the high-pressure turbine section, the intermediate-pressure turbine section, and the low-pressure turbine section share one rotor.

In the steam turbine, each of the turbines includes diaphragms and buckets with respect to the rotor in the casing, and steam rotates the rotor while passing through the diaphragms and the buckets to drive the generator.

In the related art, FIGS. 1 to 3 show bucket 2 fixed to the rotor 5 by a locking pin 3 provided between the bucket 2 and the rotor 5 in order to prevent the bucket 2 from being separated in the axial deviation during the operation of the turbine.

In case of an axial entry dovetail scheme, as illustrated in FIG. 1, the locking pin 3 is disposed on a lower groove 5*d* at a center of an inside of a joint 5*c* of an outer circumferential surface of the rotor 5 with a male dovetail 2*c* of the bucket 2. As illustrated in FIG. 2, the male dovetail 2*c* of the bucket 2 is mounted on the outer circumferential surface of the rotor 5 and then the locking pin 3 is rotated by 180° to firmly lock the bucket 2.

In this instance, the existing locking pin 3 protrudes to a side surface of the rotor 5 in an axial direction as illustrated in FIG. 3. Therefore, a flow resistance against a working fluid occurs in spaces A and B between the diaphragm 6 and the bucket 2 during the rotation of the rotor 5 that disturbs the flow of the working fluid and cause a slight turbulence phenomenon.

In addition, a clearance between the diaphragm 6 and the bucket 2 is relatively narrow in the spaces A and B compared to other points. If the rotor 5 moves in the axial direction due to a thermal expansion or the like during the operation of the turbine, collision may occur between the components.

SUMMARY

An object of the present disclosure is to provide a structure capable of reducing a windage loss due to rotation and additionally securing an axial clearance by disposing, in a depressed form, a locking member for locking a bucket to a rotor to prevent the bucket from being separated in an axial direction during an operation.

Other objects and advantages of the present disclosure can be understood by the following description, and become apparent with reference to the exemplary embodiments.

In accordance with one aspect, an apparatus for axial locking of a bucket includes: a depressed portion formed on an end of a male dovetail disposed on the bucket and on an outer side of a seating groove of a female dovetail disposed on an outer circumferential surface of a rotor disk; and a locking member configured to contact the depressed portion of the male dovetail and the seating groove of the female dovetail to prevent the bucket mounted on the rotor disk from being separated in the axial direction.

The depressed portion may include: a first depression disposed on the end of the female dovetail; and a second depression disposed on the male dovetail.

An inner circumferential surface of the first depression and an inner circumferential surface of the second depression may be rounded.

The first depression and the second depression may be rounded with the same circumferential ratio.

The locking member may include: a center beam configured to contact the end of the male dovetail and the seating groove of the female dovetail in the axial direction of the rotor disk; and a locking plate disposed on the end of the center beam to be positioned in the depressed portion.

A part of the locking plate may be rounded to be rotatable along the depressed portion.

The other part of the locking includes a flat portion so that the male dovetail is inserted into the female dovetail in an axial direction.

The locking plate may be disposed on both ends of the center beam.

The apparatus may further include: a locking protrusion disposed on the locking plate on a side facing the center beam; and a guide line disposed in the depressed portion along which the locking protrusion moves.

A cross section of the locking protrusion may be a circle.

The locking protrusion may be disposed at a middle part of the rounded portion.

The guide line may further include: an insert line disposed on the first depression; a first moving line connected to the insert line and disposed on the first depression; and a second moving line disposed on the second depression.

The insert line extends in a central direction of the rotor disk in the seating groove.

The first moving line may be rounded along a circumference of the first depression.

The second moving line may be disposed along a circumference of the second depression and rounded with the same circumferential ratio as the first moving line.

The apparatus may further include: a locking piece configured to be inserted into a first hole disposed on the locking plate and a second hole disposed in the first depression and provided to prevent a rotation of the locking member.

The first hole may be disposed in pairs on the locking plate opposing each other with respect to the center beam, and the second hole may be disposed in pairs at positions opposite to each other with respect to the seating groove in the first depression.

In accordance with another aspect, a bucket assembly includes: a disk configured to have a female dovetail disposed in plural along an outer circumferential surface thereof, the female dovetail being provided with a first depression; a bucket configured to have a male dovetail disposed on an end thereof, the male dovetail being provided with a second depression; and an apparatus for axial locking of a bucket disposed between the bucket and the disk so that the bucket is locked to the disk in an axial direction.

In accordance with still another aspect, a gas turbine includes: a casing; a compressor section disposed in the casing and configured to compress introduced air; a combustor connected to the compressor section in the casing and configured to combust the compressed air; a turbine section connected to the combustor in the casing and configured to produce power using the combusted air; a rotor configured to connect the compressor section and the turbine section to one rotating shaft; and a diffuser configured to be connected to the turbine section in the casing and discharge air to the outside, in which the compressor section or the turbine section may include the bucket assembly.

BRIEF DESCRIPTION OF THE DRAWINGS

The above and other objects, features and advantages of the present disclosure will be more clearly understood from the following detailed description taken in conjunction with the accompanying drawings, in which.

DETAILED DESCRIPTION

Hereinafter, an apparatus for axial locking of a bucket according to exemplary embodiments will be described in detail with reference to the accompanying drawings.

A configuration of a gas turbine 100 is described with reference to the accompanying drawings.

Figure 9:
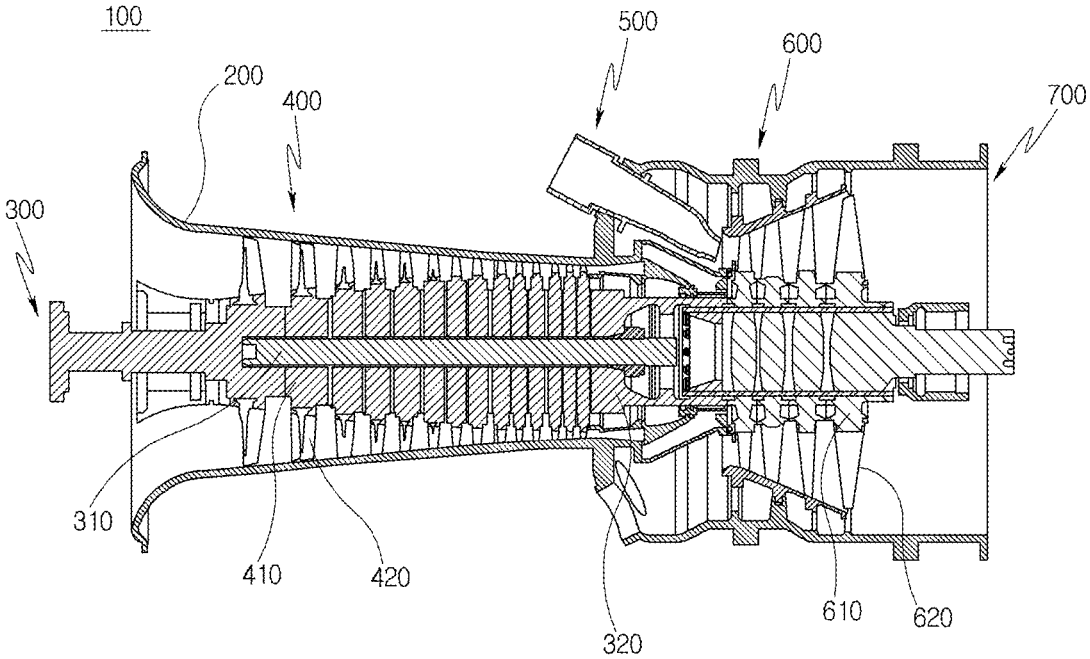
FIG. 9 is a view illustrating a gas turbine.

Referring to FIG. 9, a gas turbine 100 may be configured to include a casing 200, a compressor section 400 that compresses air, a combustor 500 that combusts air, a turbine section 600 that generates electricity using the combusted gas, a diffuser 700 that discharges exhaust gas, and a rotor 300 that connects the compressor section 400 and the turbine section 600 to transmit rotational power.

Thermodynamically, outside air is introduced into the compressor section 400 corresponding to an upper stream side of the gas turbine 100 and subjected to an adiabatic compression process. The compressed air is introduced into the combustor section 500, mixed with fuel, and subjected to an isostatic combustion process, and the combusted gas is introduced into a turbine section 600 corresponding to a downstream side of the gas turbine 100 and subjected to an adiabatic expansion process.

Describing a flow direction of air, the compressor section 400 is positioned at one end of the casing 200, and the turbine section 600 is provided at the other end of the casing 200.

A torque tube 320 is provided between the compressor section 400 and the turbine section 600 to transmit a rotational torque generated from the turbine section 600 to the compressor section 400.

The compressor section 400 is provided with a plurality of compressor rotor disks 410 (e.g., fourteen disks) and the respective compressor rotor disks 410 are fastened to each other by a tie rod 310.

The compressor rotor disks 410 are aligned with each other along an axial direction in a state in which the tie road 310 penetrates through a center of the respective compressor rotor disks 410. A flange (not illustrated) which is fixedly joined to adjacent rotor disks is formed near an outer circumferential part of the compressor rotor disk 410 to protrude in an axial direction.

Figure 1:
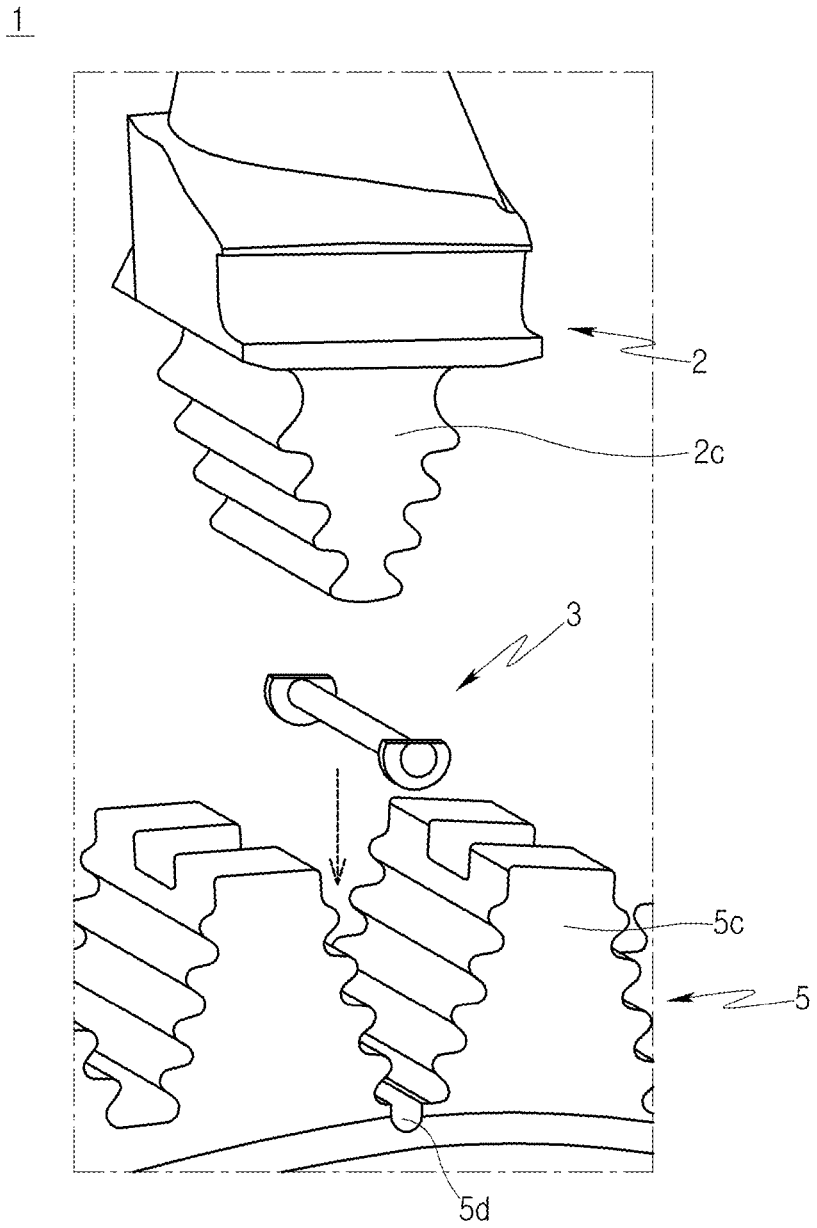
FIG. 1 is a view illustrating a state where the protruding locking member is joined between a bucket and a rotor according to a related art.
Figure 2:
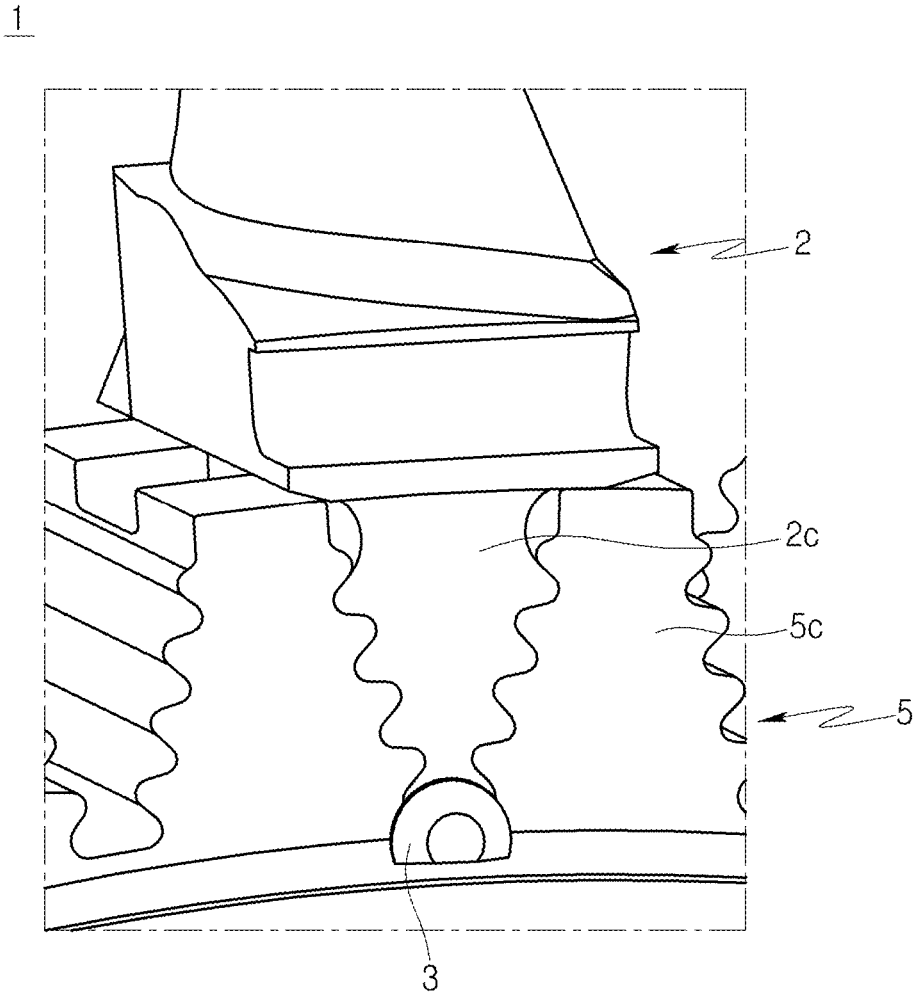
FIG. 2 is a view illustrating a state where the protruding locking member is mounted to prevent the bucket from being separated in an axial deviation according to a related art.

A plurality of blades 420 (or buckets) are radially joined to an outer circumferential surface of the compressor rotor disk 410. The respective blades 420 has a dovetail portion, such as the ones illustrated in FIGS. 1 and 2, to be fastened with the compressor rotor disk 410.

As a fastening type of the dovetail portion, there are a tangential type and an axial type. The type may be selected according to a structure required for the commonly used gas turbine. In some cases, the compressor blade 420 may be fastened to the compressor rotor disk 410 using other fastening apparatuses other than the dovetail.

Figure 3:
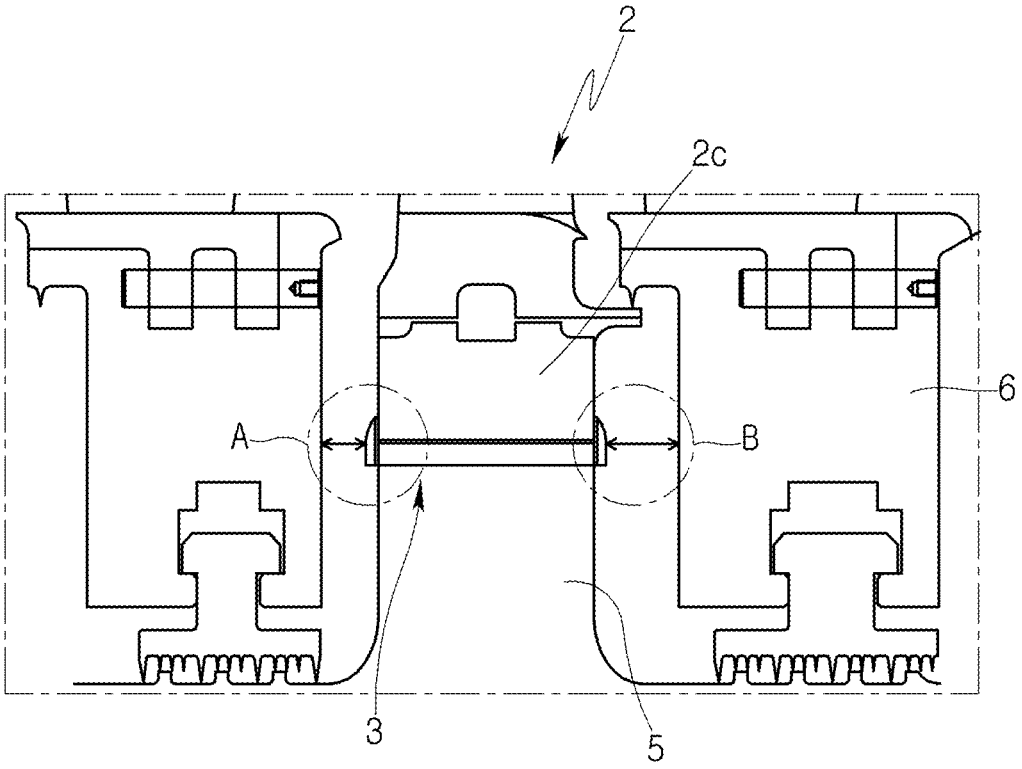
FIG. 3 is a view illustrating a clearance between a diaphragm and a bucket by the disposition of the protruding locking member according to a related art.

A vane (or referred to as a nozzle) (not illustrated) for a relative rotational movement of the compressor blade 420 on an inner circumferential surface of the compressor section 400 of the casing 200 may be mounted on a diaphragm, such as the one illustrated in FIG. 3.

Tie rod 310 is disposed to penetrate through the center of the plurality of compressor rotor disks 410. One end of the tie rod 310 is fastened to the compressor rotor disk 410 positioned on an uppermost stream side and the other end thereof is locked to the torque tube 320. The shape of the tie rod 310 may be variously configured according to the gas turbine, and thus is not necessarily limited to the shapes illustrated in the drawings.

One tie rod 310 may have a shape penetrating through the center of the compressor rotor disk 410 and a plurality of tie rods 310 may be disposed in a circumferential shape, and they may be interchangeably used.

Although not illustrated, the compressor section 400 of the gas turbine 100 may be provided with a vane serving as a guide vane at a position next to a diffuser to increase a pressure of the fluid and then adjust a flow angle of the fluid entering the combustor inlet to a design flow angle after increasing the pressure of the fluid (e.g., a desworler).

The combustor 500 mixes and combusts the introduced compressed air with fuel to produce a high-temperature and high-pressure combusted gas and increase the combusted gas temperature up to a heat-resistant temperature that components of the combustor 500 and the turbine section 600 may withstand by the isostatic combustion process.

A plurality of combustors 500 comprising a combustion system of the gas turbine 100 may be arranged in the casing 200 formed in a cell shape. The combustor 500 is configured to include a burner that includes a fuel injection nozzle and the like, a combustor liner that forms a combustion chamber, and a transition piece that is a connection portion between the combustor and the turbine section 600.

Specifically, the liner (not shown) provides a combustion space in which the fuel injected by the fuel nozzle (not shown) is mixed with the compressed air of the compressor section 400 and combusted. Such a liner may include a flame container providing the combustion space in which the fuel mixed with air is combusted and a flow sleeve forming an annular space while surrounding the flame container. In addition, a fuel nozzle is joined to a front end of the liner and an ignition plug is joined to a side wall thereof.

The transition piece is connected to a rear end of the liner so that the gas combusted by the ignition plug may be transmitted to the turbine section 600 side. An outer wall part is cooled by the compressed air supplied from the compressor section 400 to prevent the transition piece from being damaged by the high temperature of the combusted gas. To this end, the transition piece is provided with cooling holes through which air may inject thereinto, and the compressed air flows in the liner side after cooling a main body existing therein through the holes.

The cooling air cooling the foregoing transition piece flows in the annular space of the liner, and the air compressed at the outside of the flow sleeve is provided as the cooling air through the cooling holes provided on the flow sleeve and thus collide with the outer wall of the liner.

Generally, the high-temperature and high-pressure combusted gas from the combustor 500 generates an impact and a reacting force to a rotary blade of the turbine section 600 while being expanded in the turbine section 600 and is thus converted into mechanical energy. The mechanical energy obtained from the turbine section 600 is supplied as the energy required to compress the air by the compressor section 400 and the remainder is used to drive a generator to produce power.

In the turbine section 600, a plurality of stationary blades and dynamic blades are alternately disposed in a vehicle room, and the dynamic blades are driven by the combusted gas to rotate and drive the output shaft to which the generator is connected. To this end, the turbine section 600 is provided with a plurality of turbine rotor disks 610. The respective turbine rotor disks 610 basically have a shape similar to the compressor rotor disk 410.

The turbine rotor disk 610 is also provided with a flange (not illustrated) provided to be joined to the adjacent turbine rotor disks 610 and includes the plurality of turbine blades 620 (or referred to as buckets) that are disposed radially. The turbine blade 620 may also be joined to the turbine rotor disk 610 in a dovetail scheme.

A vane (or referred to as a nozzle) (not illustrated) for a relative rotational movement of the turbine blade 620 on an inner circumferential surface of the turbine section 600 of the casing 200 may be mounted on the diaphragm, such as the one illustrated in FIG. 3.

In the gas turbine having the structure as described above, the introduced air is compressed by the compressor section 400, combusted by the combustor 500, and then transported to the turbine section 600 to drive a generator and is discharged into the atmosphere through the diffuser 700.

The torque tube 320, the compressor rotor disk 410, the compressor blade 420, the turbine rotor disk 610, the turbine blade 620, the tie rod 310, and the like, may be integrated as the rotating components, which may refer to the rotor 300 or a rotating body. The casing 200, the vane (not illustrated), the diaphragm (not illustrated), and the like may be integrated as non-rotating components, which may refer to a stator or a fixed body.

The general structure of the gas turbine is as described above. Hereinafter, the exemplary embodiments of the present disclosure applied to such a gas turbine will be described below.

First Exemplary Embodiment

Figure 4:
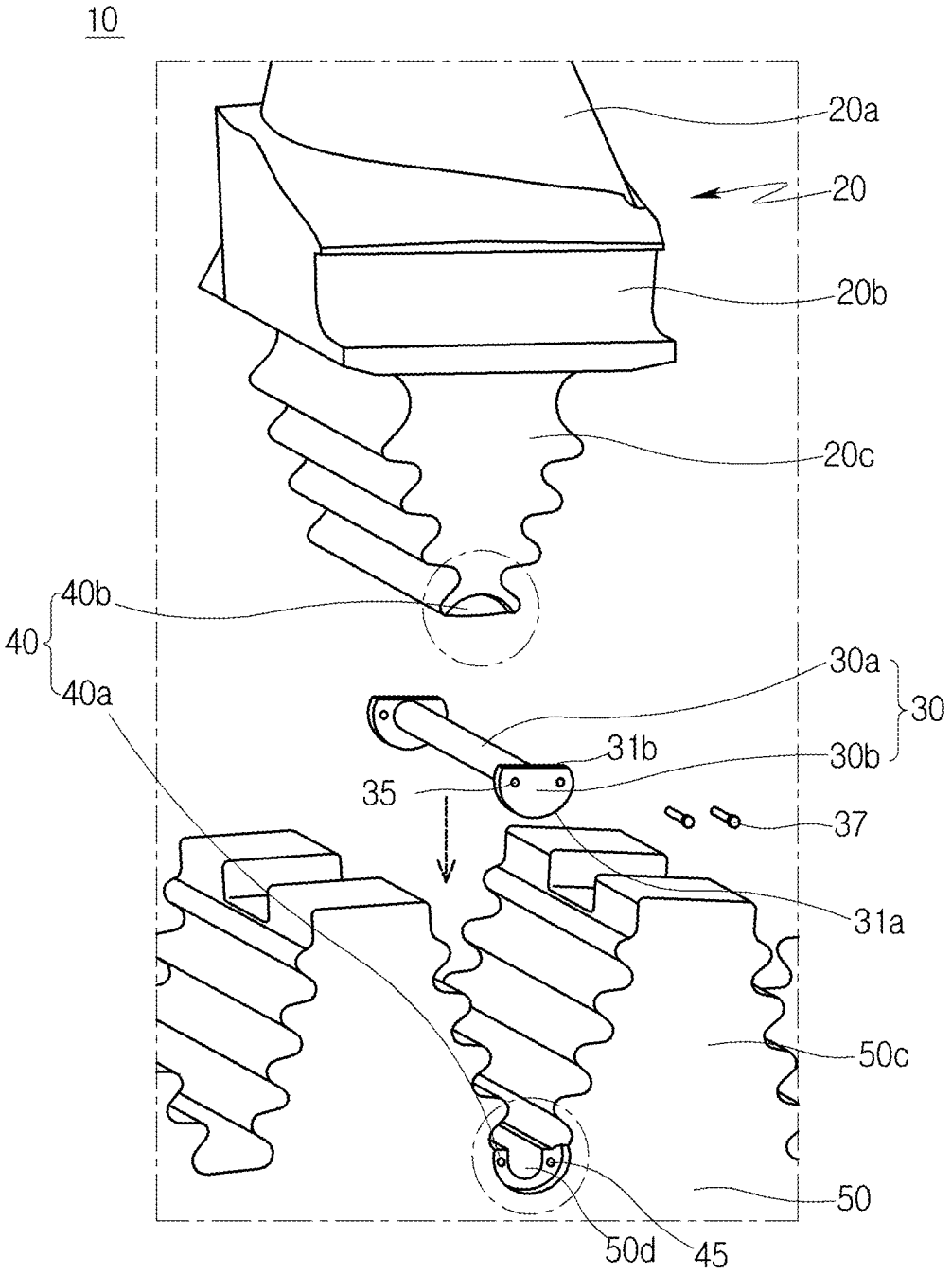
FIG. 4 is a view illustrating a state where a depressed locking member is joined between a bucket and a rotor according to an exemplary embodiment.
Figure 5:
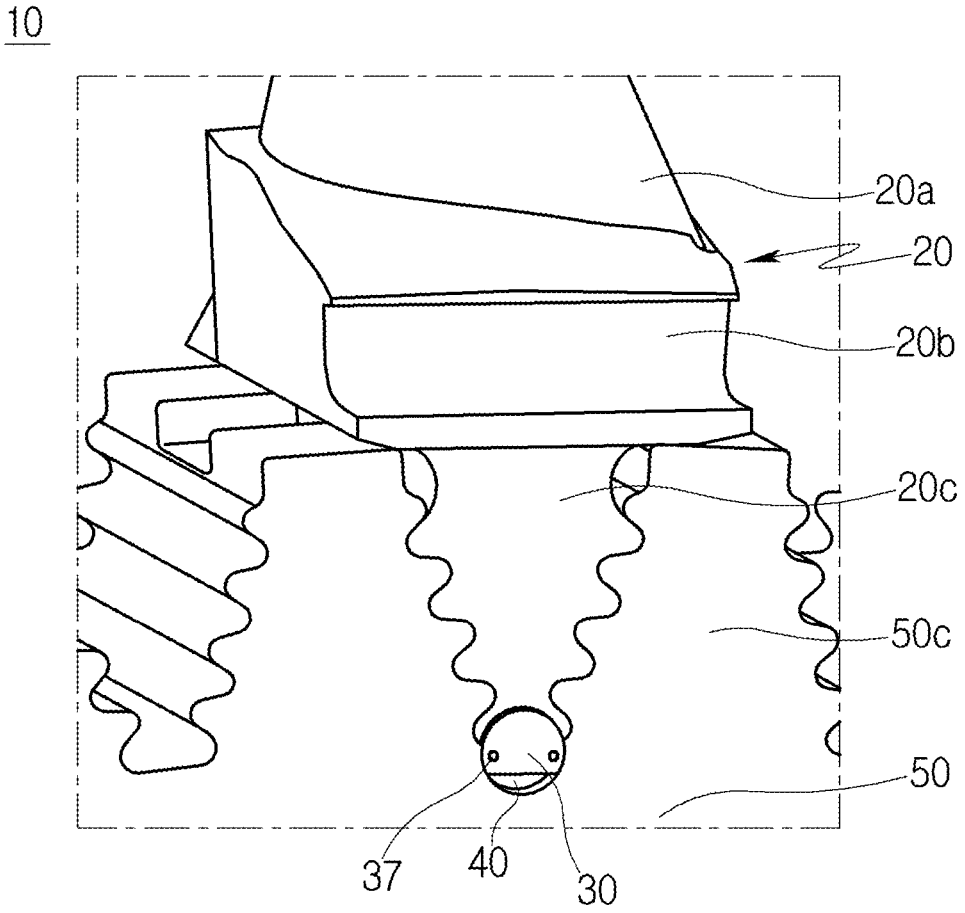
FIG. 5 is a view showing a state where the depressed locking member is mounted to prevent the bucket from being separated in an axial direction according to an exemplary embodiment.
Figure 6:
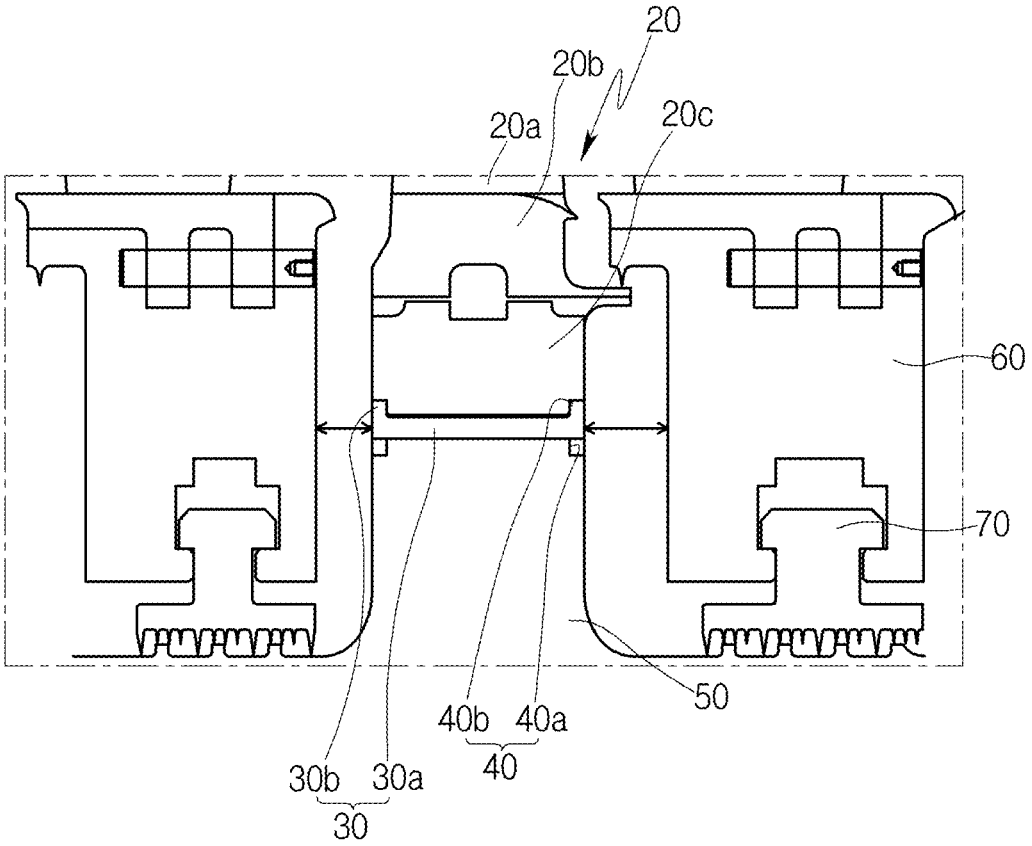
FIG. 6 is a view illustrating a clearance between the diaphragm and the bucket due to the disposition of the depressed locking member according to an exemplary embodiment.
Figure 7:
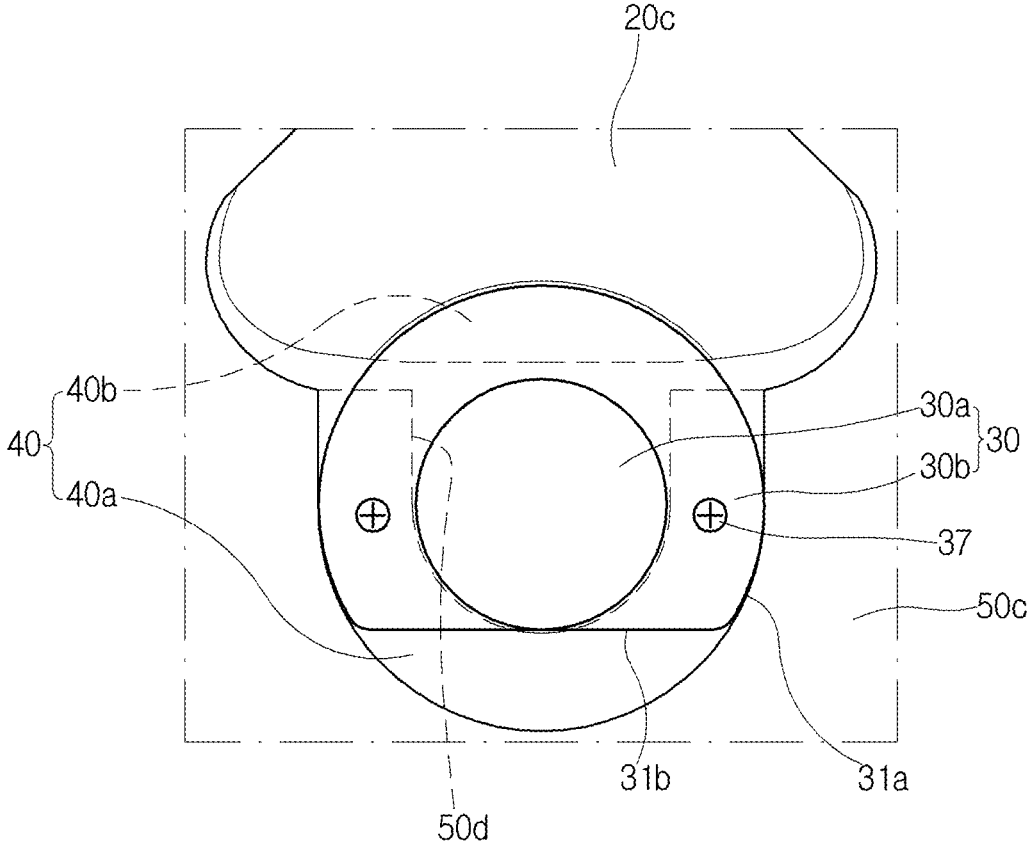
FIG. 7 is a view illustrating a joined state between a depressed portion and the locking member according to a first exemplary embodiment.

FIG. 4 is a view illustrating a state where a depressed locking member is joined between a bucket and a rotor according to an exemplary embodiment. FIG. 5 is a view showing a state where the depressed locking member is mounted to prevent the bucket from being separated in an axial direction according to an exemplary embodiment. FIG. 6 is a view illustrating a state where a clearance between the diaphragm and the bucket due to the disposition of the depressed locking member according to an exemplary embodiment. FIG. 7 is a view illustrating a joined state between a depressed portion and the locking member according to a first exemplary embodiment.

Referring to FIGS. 4 and 5, an apparatus 10 for axial locking of a bucket 20 according to a first exemplary embodiment may be configured to include a depressed portion 40 and a locking member 30.

The bucket 20 may be configured to include a blade 20*a*, a platform 20*b* on which the blade 20*a* is disposed, and a male dovetail 20*c* to be joined to an outer circumferential surface of a rotor disk 50, in which the outer circumferential surface of the rotor disk 50 may be provided with a female dovetail 50*c*. A lower central side of the female dovetail 50*c* may be provided with a seating groove 50*d*.

A depressed portion 40*b* may be formed on an end of the male dovetail 20*c* and a depressed portion 40*a* may be formed on an end of the seating groove 50*d* of the female dovetail 50*c*. The depressed portion 40 may be configured to include the first depression 40*a* and the second depression 40*b*.

As shown in FIG. 4, the first depression 40*a* may be formed in a lower seating groove 50*d* of the female dovetail 50*c* and the second depression 40*b* may be formed at a lower end of the male dovetail 20*c*. The inner circumferential surfaces of the first and second depressions 40*a* and 40*b* may be rounded at the same circumference ratio.

The locking member 30 is configured to come into contact with a lower end surface of the male dovetail 20*c* and the seating groove 50*d* of the female dovetail 50*c* to prevent the bucket 20 mounted on the rotor disk 50 from being separated in the axial direction and may be provided to be disposed in the depressed portion 40.

As shown in FIG. 4, the locking member 30 may include a center beam 30*a* and a locking plate 30*b*. First, the center beam 30*a* may be disposed to come into contact with the end of the male dovetail 20*c* and the seating groove 50*d* of the female dovetail 50*c* in the axial direction of the rotor disk 50. The locking plate 30*b* may be disposed on the end of the center beam 30*a* so as to be positioned in the depressed portion 40.

The locking plate 30*b* is positioned in the depression 40*a* when the center beam 30*a* is positioned in the seating groove 50*d*.

The locking plate 30*b* includes a rounded portion 31*a* configured to rotate along the depressed portion 40 and a flat portion 31*b* so that the male dovetail 20*c* may be inserted into the female dovetail 50*c* in an axial direction. The locking plates 30*b* may be disposed in pairs and arranged on both side ends of the center beam 30*a* so as to prevent the bucket from being separated in the axial direction.

As illustrated in FIG. 4, the locking plate 30*b* is inserted into the seating groove 50*d* of the female dovetail 50*c* such that the flat portion 31*b* is disposed outwardly in a radial direction of the rotor disk 50 (i.e., upward direction in the drawing).

The male dovetail 20*c* of the bucket 20 is inserted into the female dovetail 50*c* in the axial direction. At this time, since the flat portion 31*b* is positioned outwardly in the radial direction, the insertion of the male dovetail 20*c* is smoothly performed.

Thereafter, as illustrated in FIG. 5, the locking member 30 is rotated by 180° to prevent the male dovetail 20*c* from being separated in the axial direction.

The rounded portion 31*a* allows the locking member 30 to be smoothly rotated on the inner circumferential surface of the depressed portion 40. After the locking member 30 is rotated, the flat portion 31*b* is positioned towards the center direction of the rotor disk 50 (i.e., downward direction in the drawing). Accordingly, the rounded portion 31*a* forms a locked position to prevent the male dovetail 20*c* from being separated in the axial direction.

Referring to FIG. 6, the exemplary embodiment described above provides the side end surfaces of the locking plate 30*b* of the locking member 30 to be in a flat state, and therefore there is no part protruding from the side surface of the bucket 20 and the rotor disk 50. Due to the above structure, a flow resistance against the working fluid does not occur during the operation of the turbine.

Further, since a clearance from the diaphragm 60 is maintained constantly, even if vibration the thermal expansion during the operation of the turbine moves the rotor disk 50 in the axial direction, possible collision between the diaphragm 60 and the bucket 20 or the rotor disk 50 may be avoided or further lowered compared to the related art.

FIG. 7 shows the state in which the male dovetail 20*c* and the female dovetail 50*c* are locked by the locking member 30. Referring to FIG. 7, the center beam 30*a* of the locking member 30 is stably inserted into the seating groove 50*d*, and the rounded portion 31*a* of the locking plate 30*b* is rotated by 180° to prevent the male dovetail 20*c* from being separated in the axial direction.

After the locking plate is rotated by 180°, the locking plate 30*b* may be fixed by using a caulking operation or using a locking piece 37, such as a bolt and a set screw, for example, so that the locking plate 30*b* does not rotate. Referring to FIGS. 4 and 5, the locking piece 37 is inserted into a second hole 45 provided in the first depression 40*a* and the first hole 35 provided on the locking plate 30*b*.

As shown in FIG. 4, first hole 35 is disposed in pairs at positions opposed to each other with respect to the center beam 30*a* on the locking plate 30*b*, and second hole 45 is disposed in pairs at positions opposed to each other with respect to the center of the seating groove 50*d* on the first depression 40*a*, such that the locking plate 30*b* can lock both parts by the locking piece 37.

Since the circumferential ratio of the rounded portion 31*a* of the locking plate 30*b* matches the circumferential ratio of the depressed portion 40, the rotation of the locking plate 30*b* is smooth, and even after the rotation of the locking plate 30*b*, the locking plate 30*b* is fitted in the second depressed portion 40*b*, thereby more stably preventing the bucket 20 from being separated in the axial direction.

Second Exemplary Embodiment

Figure 8A:
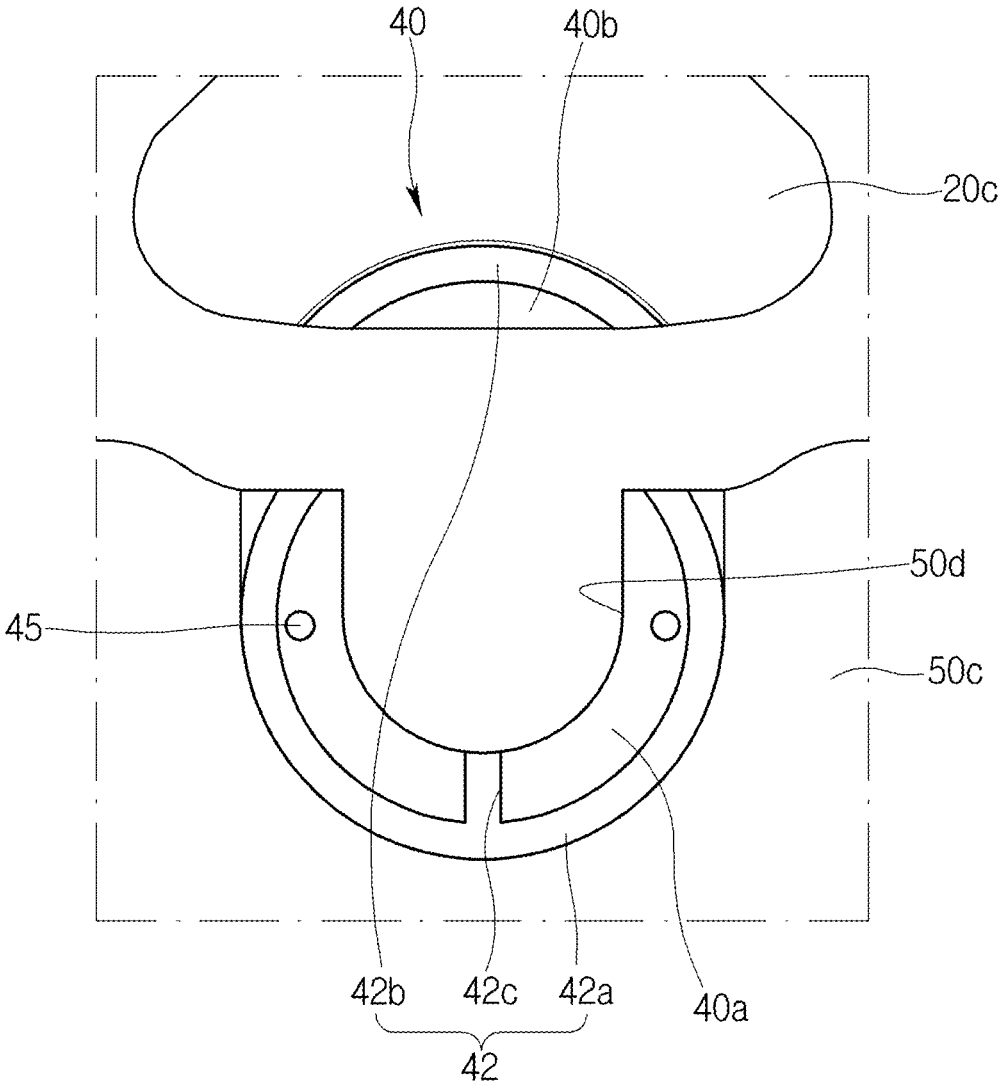
FIGS. 8A to 8C are views illustrating a joined structure of the depressed portion and the locking member according to a second exemplary embodiment.
Figure 8B:
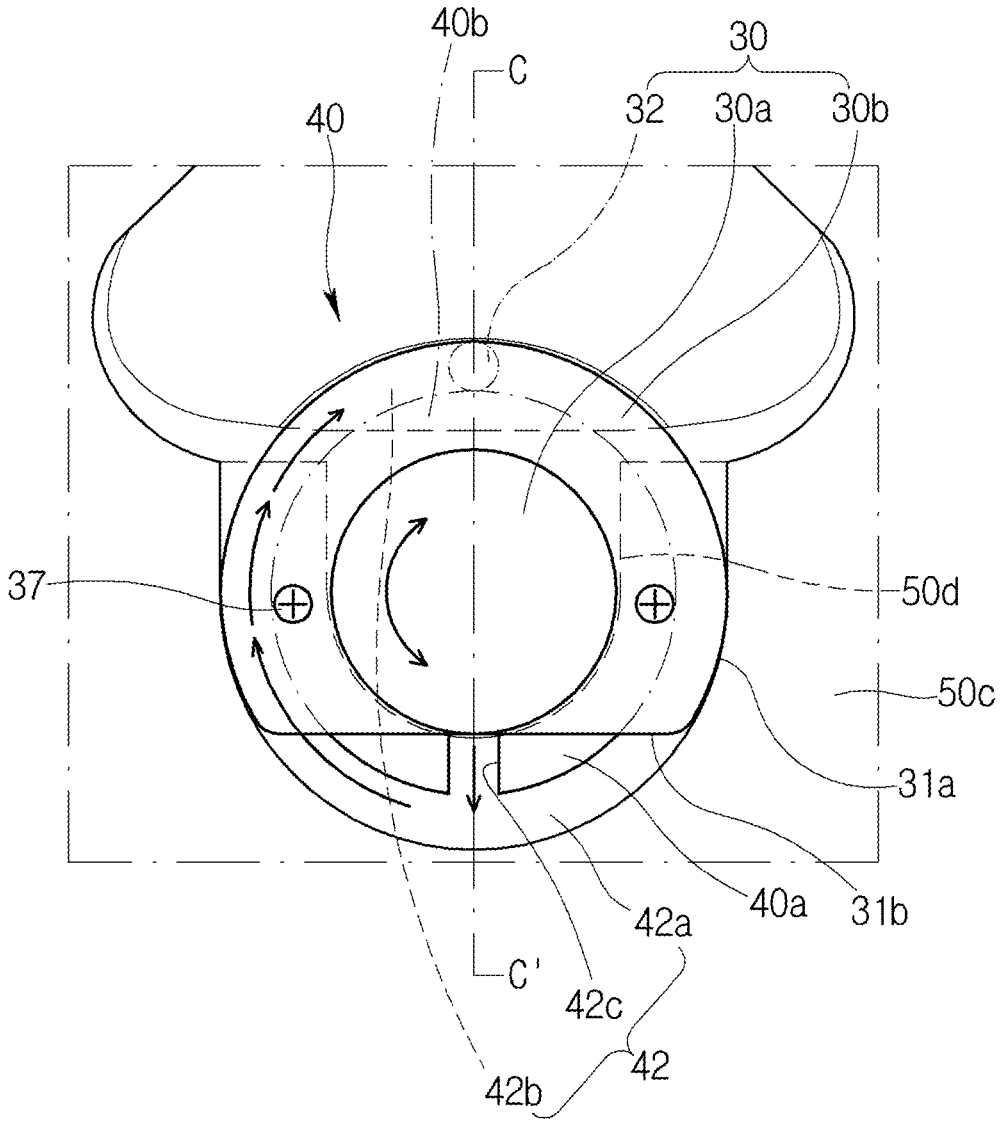

FIGS. 8A to 8B are views illustrating a joined structure of a depressed portion and a locking member according to a second exemplary embodiment.

As explained above, FIG. 5 illustrates an apparatus for axial locking of a bucket 20 according to a first exemplary embodiment including the depressed portion 40 and the locking member 30.

The descriptions of the first depression 40*a*, the second depression 40*b*, and the second hole 45 comprising the depressed portion 40, and the center beam 30*a*, the locking plate 30*b*, the first hole 35, and the locked piece 37 comprising the locking member 30 are the same as those of the first exemplary embodiment and therefore will be omitted below. Hereinafter, a locking protrusion 32 and a guide line 42 that are additionally included in the second exemplary embodiment will be described.

Figure 8C:
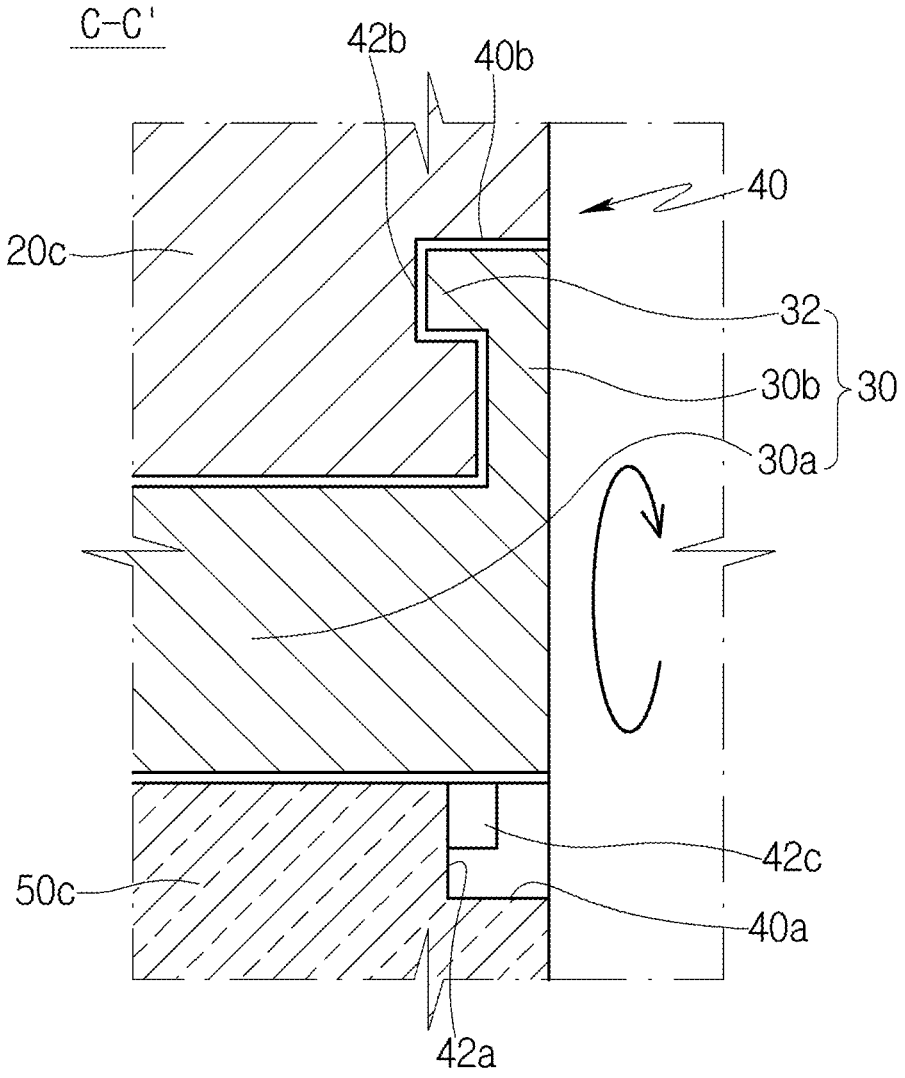

As shown in FIGS. 8A-8C, the locking protrusion 32 may be disposed on a side of the locking plate 30*b* facing the center beam 30*a*. The locking plates 30*b* may be disposed in pairs with one on each end of the center beam 30*a* and thus, the locking protrusions 32 may be disposed in pairs with one on the side of each locking plate 30*b* facing the center beam 30*a*.

In the exemplary embodiment, the locking protrusion 32 may be formed having a circular cross section (e.g., a cylinder, a cone, etc.) so as to smoothly move along the guide line 42, but the shape is not necessarily limited thereto. Further, the locking protrusion 32 may be disposed at a middle portion of the rounded portion 31*a*.

The guide line 42 may be disposed in the depressed portion 40, and the locking protrusion 32 may be configured to be moved in the guide line 42. The guide line 42 may be configured to include an insert line 42*c*, a first moving line 42*a*, and a second moving line 42*b*.

Referring to FIG. 8A, the insert line 42*c* is formed in the first depression 40*a* extending towards the center of the rotor disk 50. The insert line 42*c* defines a path through which the locking protrusion 32 is inserted when the locking member 30 is positioned in the seating groove 50*d* of the female dovetail 50*c*.

The first moving line 42*a* is formed along the circumference of the first depression 40*a* and is connected to the insert line 42*c*. The locking protrusion 32 inserted along the insert line 42*c* is rotated along the first moving line 42*a* when the locking member 30 is rotated by 180°.

The second moving line 42*b* is formed along the circumference of the second depression 40*b* at the same circumferential ratio as the first moving line 42*a*, such that the locking protrusion 32 moves from the first moving line 42*a* to the second moving line 42*b* during rotation.

Referring to FIG. 8B, the locking protrusion 32 is inserted along the insert line 42*c* and when the locking plate 30*b* is rotated by 180°, the locking protrusion 32 moves along the first and second moving lines 42*a* and 42*b* into the locked position.

Referring to FIG. 8C, which is a cross-sectional view along line C-C' in FIG. 8B, the locking protrusion 32 is moved into the locked position along the second moving line 42*b* inside of the male dovetail 20*c* to improve the fixing force of the male dovetail 20*c*, thereby further mitigating the axial separation of the bucket 20.

According to the present disclosure, as the locking member for locking the bucket to the rotor to prevent the bucket from being separated in the axial direction during the operation is disposed in the depressed form, it is possible to reduce the fluid resistance due to the locking member during the rotation of the rotor and the bucket. Conventionally, the locking member is disposed in the protruding form and thus the fluid resistance occurs during the rotation. However, according to the present disclosure, the locking member is disposed in the depressed form and thus the fluid resistance is minimized.

In addition, since the locking member is disposed in the depressed form, the clearance between the diaphragm and the bucket is more reliable than that of the existing protruding locking member, such that even if the axial movement of the rotor occurs due to vibration, thermal expansion or the like during the operation of the turbine, the possibility of collision between the bucket and the diaphragm can be further reduced and the flow of the working fluid can be performed more smoothly, thereby ultimately contributing to the improvement of turbine power generation efficiency.

The above description only shows specific exemplary embodiments of the apparatus for axial locking of a bucket.

Therefore, it is to be noted that the present disclosure may be variously substituted and modified by those skilled in the art without departing from the spirit of the present disclosure as recited in the accompanying claims.

What is claimed is:

1. An apparatus for axial locking of a bucket mounted to a rotor disk in a turbine, the apparatus comprising:

a female dovetail extending from an outer circumferential surface of the rotor disk;

a male dovetail that extends from the bucket and is configured to be inserted into the female dovetail in an axial direction of the rotor disk;

a locking member including a center beam and a locking plate disposed on an end of the center beam, the locking member configured to be placed between the male dovetail and a seating groove of the female dovetail and to be rotated about an axis of the center beam into either of a first position and a second position that is 180 degrees from the first position; and a depressed portion disposed on a surface formed by a combination of an axially outer end portion of the male dovetail and an axially outer side of the seating groove of the female dovetail and configured to receive the locking plate of the locking member, the depressed portion including:

a first depression formed in the axially outer side of the seating groove of the female dovetail, the first depression including:

a first axially facing surface for guiding the rotation of the locking member, and a first curved surface extending perpendicularly from the first axially facing surface and having a curvature corresponding to a circumferential surface of the locking plate to receive the locking member rotated into the second position; and a second depression formed in the axially outer end portion of the male dovetail, the second depression including:

a second axially facing surface for guiding the rotation of the locking member, and a second curved surface extending perpendicularly from the second axially facing surface and having a curvature corresponding to the circumferential surface of the locking plate to receive the locking member rotated into the second position, wherein the locking member is further configured to engage the first curved surface when the locking member is rotated into the first position to enable insertion of the male dovetail into the female dovetail in the axial direction, and engage the second curved surface when the locking member is rotated into the second position to prevent the bucket from being separated from the rotor disk in the axial direction.

2. The apparatus of claim 1, wherein the first curved surface is an inner circumferential surface of the first depression and resides on an imaginary circle concentric with a center of the center beam of the locking member, and wherein the second curved surface is an inner circumferential surface of the second depression and resides on the imaginary circle.

3. The apparatus of claim 2, wherein the imaginary circle includes a first arc portion coinciding with the inner circumferential surface of the second depression and a second arc portion coinciding with the inner circumferential surface of the first depression, wherein the inner circumferential surface of the first depression has a first circumferential length, and the inner circumferential surface of the second depression has a second circumferential length, and wherein the first depression and the second depression are rounded with the same circumferential ratio, such that a ratio of the first circumferential length to a circumferential length of the first arc portion and a ratio of the second circumferential length to a circumferential length of the second arc portion have a product equal to one.

4. The apparatus of claim 1, wherein the center beam center beam is disposed in the axial direction and is configured to be placed between the axially outer end portion of the male dovetail and the seating groove of the female dovetail.

5. The apparatus of claim 1, wherein the circumferential surface of the locking plate includes a flat portion enabling the insertion of the male dovetail into the female dovetail.

6. The apparatus of claim 1, wherein the locking plate is disposed on both ends of the center beam.

7. The apparatus of claim 1, wherein the locking plate includes a first side facing the center beam and a second side opposite to the first side, the apparatus further comprising:

a locking protrusion that is disposed on the first side of the locking plate inside the imaginary circle and rotates together with the locking member; and a guide line groove formed in the first and second axially facing surfaces of the depressed portion and configured to engage the locking protrusion throughout the rotation of the locking member between the first and second positions, the guide line groove forming an annular groove when the male dovetail is fully inserted into the female dovetail.

8. The apparatus of claim 7, wherein a cross section of the locking protrusion is a circle, and wherein the locking protrusion at the circular cross section has opposite sides that respectively engage opposite sides of the guide line groove so as to smoothly move the locking protrusion along the guide line groove throughout the rotation of the locking member between the first and second positions.

9. The apparatus of claim 7, wherein the circumferential surface of the locking plate includes a flat portion and a rounded portion communicating with each of opposite ends of the flat portion, and wherein the locking protrusion is centrally disposed along a circumferential length of the rounded portion of the locking plate.

10. The apparatus of claim 7, wherein the annular groove formed by the guide line groove includes:

a first moving line groove that is axially recessed into the first axially facing surface of the first depression, the locking protrusion engaging the first moving line groove when the locking member is rotated into the first position; and a second moving line groove that is axially recessed into the second axially facing surface of the second depression, the locking protrusion engaging the second moving line groove when the locking member is rotated into the second position.

11. The apparatus of claim 10, wherein the guide line groove further includes an insert line groove that is formed in the first axially facing surface of the first depression and communicates with the first moving line groove, and wherein the insert line groove is configured to receive the locking protrusion when the locking member is rotated to the first position.

12. The apparatus of claim 11, wherein the insert line groove extends radially from a center position of a circumferential length of the first moving line groove to an outer circumference of the center beam.

13. The apparatus of, claim 10 wherein the first moving line groove includes a radially outer surface that axially extends continuously from the first curved surface of the first depression and a radially inner surface that extends in parallel with the first curved surface of the first depression, and wherein the second moving line groove includes a radially outer surface that axially extends continuously from the second curved surface of the second depression and a radially inner surface that extends in parallel with the second curved surface of the second depression.

14. The apparatus of claim 13, wherein the second moving line is rounded with the same circumferential ratio as the first moving line.

15. The apparatus of claim 1, wherein the first depression has at least one locking hole, the apparatus further comprising:

a locking piece including at least one shaft extending in a longitudinal direction of the locking piece, each of the at least one shaft of the locking piece configured to be inserted through the locking plate into a corresponding locking hole of the at least one locking hole of the first depression to fix the locking member in the second position.

16. The apparatus of claim 15, wherein the locking plate has at least one through hole configured to receive the shaft of the locking piece.

17. The apparatus of claim 16, wherein the at least one though hole includes a pair of through holes respectively disposed on opposite sides of the axis of the center beam, and wherein the at least one locking hole includes a pair of locking holes respectively disposed on opposite sides of seating groove to correspond to the pair of through holes.

18. A bucket assembly, comprising:

a disk including a plurality of female dovetails disposed along an outer circumferential surface of the disk, each of the female dovetails including a first depression formed in an axially outer side of the seating groove of the female dovetail;

a bucket including a male dovetail disposed on an end of the bucket, the male dovetail including a second depression formed in the axially outer end portion of the male dovetail; and a locking device disposed between the bucket and the disk and configured to lock the bucket to the disk in an axial direction, the locking device comprising a locking member including a center beam configured to be inserted into the seating groove of the female dovetail and a locking plate disposed on an end of the center beam and configured to be seated in the depressed portion, the locking member configured to be placed between the male dovetail and the seating groove of the female dovetail and to be rotated about an axis of the center beam into either of a first position and a second position that is 180 degrees from the first position, wherein the first depression includes:

a first axially facing surface for guiding the rotation of the locking member, and a first curved surface extending perpendicularly from the first axially facing surface and having a curvature corresponding to a circumferential surface of the locking plate to receive the locking member rotated into the second position;

wherein the second depression includes:

a second axially facing surface for guiding the rotation of the locking member, and a second curved surface extending perpendicularly from the second axially facing surface and having a curvature corresponding to the circumferential surface of the locking plate to receive the locking member rotated into the second position; and wherein the locking member is further configured to engage the first curved surface when the locking member is rotated into the first position to enable insertion of the male dovetail into the female dovetail in the axial direction, and engage the second curved surface when the locking member is rotated into the second position to prevent the bucket from being separated from the rotor disk in the axial direction.

19. A gas turbine, comprising:

a casing;

a compressor section disposed in the casing and configured to compress introduced air;

a combustor connected to the compressor section in the casing and configured to combust the compressed air;

a turbine section connected to the combustor in the casing and configured to produce power using the combusted air;

a rotor connecting the compressor section and the turbine section by a rotating shaft; and a diffuser connected to the turbine section in the casing and configured to discharge air to the outside, wherein one of the compressor section and the turbine section includes the bucket assembly of claim 18.

* * * * *